US005301702A

United States Patent [19]

McKinney

[11] Patent Number: 5,301,702

[45] Date of Patent: Apr. 12, 1994

[54] TANK POWER JET ASSEMBLY

[76] Inventor: Robert D. McKinney, 114 Stuart Dr., Vidalia, La. 71373

[21] Appl. No.: 951,786

[22] Filed: Sep. 28, 1992

[51] Int. Cl.[5] ..... B08B 3/02; B08B 9/12

[52] U.S. Cl. ..... 134/167 R; 134/107; 239/251

[58] Field of Search ..... 134/107, 167 R, 168 R, 134/177, 179; 239/251, 589, 601

[56] References Cited

U.S. PATENT DOCUMENTS

| | | | |
|---|---|---|---|
| 1,857,766 | 5/1932 | Peterson | 134/167 R X |
| 2,045,752 | 6/1936 | Butterworth | 134/168 R X |
| 2,218,625 | 10/1940 | Rudigier | 134/167 R X |
| 2,602,003 | 7/1952 | Wellborn | 134/179 X |
| 3,113,046 | 12/1963 | Reddick et al. | 134/168 R X |
| 3,595,256 | 7/1971 | Waltman et al. | 134/167 R |
| 4,244,524 | 1/1981 | Wellings | 134/167 R X |

FOREIGN PATENT DOCUMENTS

| | | | |
|---|---|---|---|
| 264126 | 7/1963 | Australia | 239/251 |
| 254449 | 5/1967 | Austria | 134/179 |
| 2318109 | 11/1973 | Fed. Rep. of Germany | 134/167 R |

*Primary Examiner*—Philip R. Coe
*Attorney, Agent, or Firm*—David L. Ray

[57] ABSTRACT

A method and apparatus for preventing formation of solids in a tank and for removing solids contained in the tank, a pipe assembly rigidly connected to the tank for conveying heated liquids to the interior of the tank, a rotatable jet assembly rotatably connected to the pipe assembly for receiving the heated liquids from the pipe assembly and spraying the heated liquids onto the bottom of the tank.

6 Claims, 3 Drawing Sheets

TANK POWER JET ASSEMBLY

BACKGROUND OF THE INVENTION

1. Field of the Invention

The invention relates to devices for removing solid deposits in tanks and vessels and for preventing formations of solid deposits on the bottom of the tanks. In particular, the invention is related to devices for removing solid deposits in crude oil storage tanks and preventing formations of solid deposits on the bottom of the tanks.

2. Description of the Related Art

Devices for cleaning tanks or vessels and/or for preventing deposits from forming on the bottom of the tanks or vessels are known in the art. Exemplary of such devices are the following U.S. Patents:

U.S. Pat. No. 4,913,819 discloses a liquid jet solids removal system for process vessels for removing solids such as sand and sediment which accumulate along the bottom wall of the vessel during operation. A plurality of elongated manifolds are arranged to extend longitudinally along the vessel bottom wall and each manifold is provided with an array of jet nozzles which are arranged along the manifold bottom side and top side, respectively. The nozzles extend in a direction such as to create a substantially vortical flow of liquid to entrain and urge the fluidized solids mixture toward the solid removal outlet opening in the vessel. The manifolds are supported in a standoff position from the vessel bottom wall by adjustable support brackets and a generally arcuate shield is supported above and spaced from each of the jet manifolds to redirect the liquid flow out of the nozzles to enhance the vertical flow pattern.

U.S. Pat. No. 4,244,523 discloses an apparatus for cleaning tanks or vessels, such as automotive and railway tank cars. A tiltable frame having a wash nozzle assembly pivotedly mounted thereon is pivotedly mounted above a fixed support frame. The tiltable frame has, fixedly mounted thereon, an air motor which is operatively connected to a second gear box. The first gear box is operatively connected to the wash nozzle assembly to move the assembly back and forth along the longitudinal axis of the tank or vessel to be cleaned. The second gear box is operatively connected to the fixed support frame to tilt the tiltable frame and thereby move the wash nozzle in both directions along the latitudinal axis of the tank of vessel to be cleaned.

U.S. Pat. No. 3,985,572 discloses an automatic spray cleaning apparatus and method for rapidly and efficiently removing material coated on the surface of an object. In accordance with the invention the axis of the cleaning liquid spray forms an acute angle with the object surface and such angle, as well as the distance along such axis between the spray nozzle and the object surface, are both maintained substantially constant over a given surface area. In addition, the pressure of the cleaning liquid at the surface of of the object is also maintained substantially constant over such given area. The spray nozzles are automatically moved rotationally about a cleaning axis and longitudinally along such axis to scan over the object surface along a predetermined path while maintaining the spacing distance and angle substantially constant during rotation of the nozzles about the cleaning axis at a given longitudinal position on such axis, by a motor operated drive which may be controlled by an electronic computer. The cleaning apparatus is especially useful for cleaning the interior surface of container tanks, such as chemical reactor tanks which contain internal baffles and other obstructions. The nozzles are mounted on folding support arms which are supported on a vertical shaft to fold such arms in and out relative to the axis of such shaft. In addition, the support shaft rotates the nozzles through a predetermined horizontal arc and also raises and lowers the cleaning apparatus. The cleaning apparatus is supported on a mobile derrick for movement of such apparatus along guide rails between a plurality of container tanks. The reactive forces produced by the liquid spray on the spray nozzles are balanced so that the total bending force exerted on the vertical shaft is kept at a minimum regardless of the position of the folding support arms carrying such nozzles.

U.S. Pat. No. 3,827,634 discloses a cleaning device for the interior of tanks, silos and the like which has a foldable and spreadable framework carrying spray heads. The framework can be folded to permit insertion through an opening, and can then be spread in the interior of the receptacle. The interior framework can be rotated about a longitudinal axis, and each of the spray heads can in itself be rotated with reference to the framework.

U.S. Pat. No. 3,791,393 discloses a tank cleaning apparatus for cleaning the interior of elongated tanks or tanks where access to the interior is limited including a tank cleaning machine attached to a source of cleaning liquid. The tank cleaning machine is movably affixed to a track and drives along the track during the cleaning operation, the track extending through the area of the tank to be cleaned so that the cleaning operation extends to portions of tank interior where access from the outside is limited. An externally mounted gas tight winch is preferred as the drive. A flexible hose provides connection between the tank cleaning machine and the source of cleaning liquid and the hose may be calibrated so that the position of the tank cleaning machine within the tank can be determined. Entry to the tank interior for mounting and dismounting the tank cleaning machine on the track is through an entry port located adjacent one end of the track.

U.S. Pat. No. 3,542,593 discloses a method and apparatus for cleaning a bedded residue from the floor of a tank such as a fermentation tank of a brewery. Arms are provided from which pressure jets of water are sprayed and which can be raised and lowered by pressure of the water through regulation of the volume supplied, the arms being foldable into a small compass for passing the same through the tank's manhole. The arms are also provided with scraper vanes attached to the underside of same to facilitate movement of the yeast to the outlet drain of the fermentation tank.

U.S. Pat. No. 3,188,238 discloses a tank cleaning method and apparatus for the cleaning of tanks used for the storage of chemicals and carried on a portable supporting structure, the apparatus including a cleaning fluid container, a device for applying pressure to the fluid in the container, the container also being supported by the structure, a fluid spray head adapted to be inserted into the tank, a conduit communicating the container with the spray head, a source of pressurized gas, and a conduit connecting the spray head with the source whereby the fluid and the gas can be simultaneously introduced into the spray head to form a mist which is distributed throughout the interior of the tank, and wherein pressure is applied to the fluid by a pneumatic device which is included in an air brake system for the structure, the pneumatic device also providing a source for the pressurized gas.

U.S. Pat. No. 3,182,669 discloses a combined a tanker service unit for installation within fluid containing tanks, the service unit including a vertically disposed tubular structure anchored within the tank, the tubular structure having one or more heating sections, and one or more diffusion sections, nozzles in the diffusion sections directed exteriorly of the sections, a device to supply a heating medium condensate from the heating sections, and a device to supply a cleaning fluid to the diffusion sections for ejection through the nozzles.

U.S. Pat. No. 2,074,052 discloses an apparatus for cleaning the interior of tanks including the combination of a laterally flexible member acting both as support and supply pipe and capable of being extended to a variable depth within the tank, and a spray head on the end of the support, the spray head including a fixed body being formed into an external bevel gear, a second portion of the body being formed into a second gear, and with a liquid passage in the interior of the fixed body, and a rotating body rotatively affixed to the fixed body, the rotating body having a cross form, with internal water passages, one arm of the cross terminating in a yoke, carrying a worm gear, the water passage in this arm extending through one side of the yoke and axially through worm gear shaft, which shaft extended, terminates in a T having mounted therein nozzles or reaction type to convert liquid pressure into rotative motion of shaft and worm which is rotatively mounted in the yoke, whereby the worm, working upon the second gear of the fixed body may cause the rotating body to turn with respect to the fixed body about their common center-line, the other arm of the cross having rotatively mounted upon its outer end a bevel gear which meshes with the bevel gear of the fixed body, the water passage of this cross arm extending axially through the bevel gear and terminating in a T having mounted therein nozzles formed to convert liquid pressure into velocity energy of jets.

U.S. Pat. No. 1,545,896 discloses an apparatus for washing sediment from oil tanks, including the combination of a pipe, a discharge nozzle on the end of the pipe, a device within the tank supporting the nozzle for translatory movement in a horizontal plane, and a device operable from the exterior of the tank for moving the nozzle in a vertical plane.

SUMMARY OF THE INVENTION

In accordance with the present invention there is provided a method and apparatus for preventing formation of solids in a tank and for removing solids contained in the tank, a pipe assembly rigidly connected to the tank for conveying heated liquids to the interior of the tank, a rotatable jet assembly rotatably connected to the pipe assembly for receiving the heated liquids from the pipe assembly and spraying the heated liquids onto the bottom of the tank.

BRIEF DESCRIPTION OF THE PREFERRED EMBODIMENTS

Figure 1:
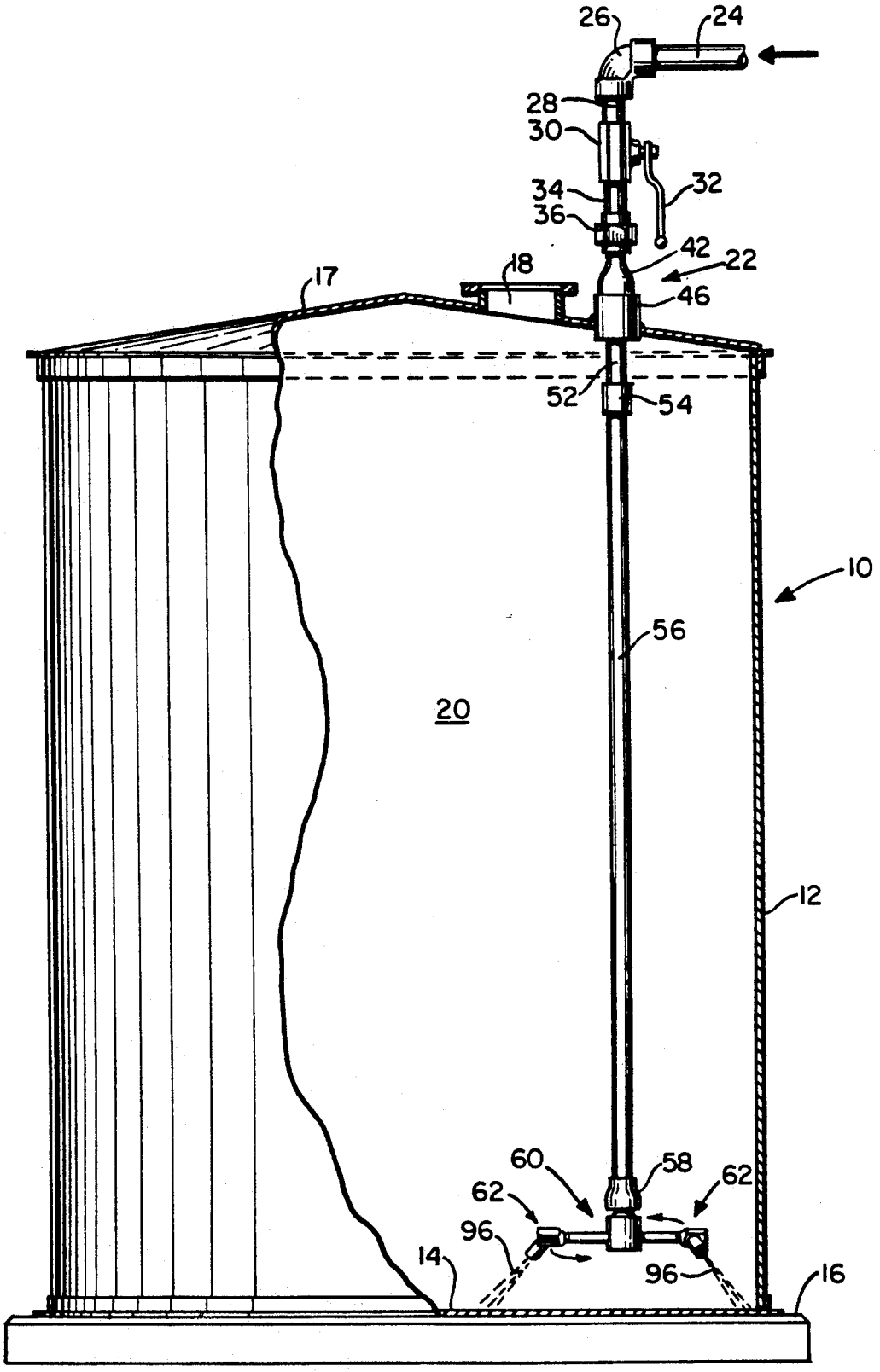
FIG. 1 is an elevational view, partly cut-away, of a tank having the tank power jet assembly of the invention connected thereto.
Figure 2:
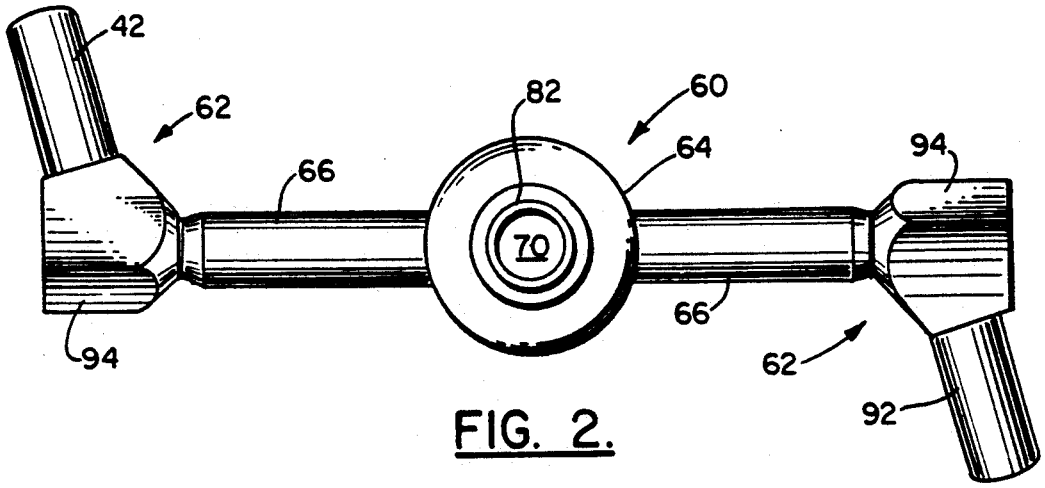
FIG. 2 is top view of the rotating jet assembly.

Referring now to the drawings, in FIG. 1 is shown a tank or vessel generally indicated by the numeral 10 for storing crude oil or other liquids. Tank 10 is generally cylindrical in shape, and has vertical side walls 12 and a bottom 14 which sits on a horizontal base or slab 16. At the top 17 of tank 10 is a port or opening 18 into which crude oil or other liquids may be poured or pumped into the interior 20 of tank 10.

Connected to the top 17 of tank 10 is the tank power jet assembly generally indicated by the numeral 22. Power jet assembly 22 has a top inlet pipe 24 for supplying hot liquid such as oil from a heater-treater or other source under pressure to power jet assembly 22. Pipe 24 is connected by elbow 26 and pipe 28 to valve 30 having actuator or handle 32 for opening and closing valve 30.

Figure 6:
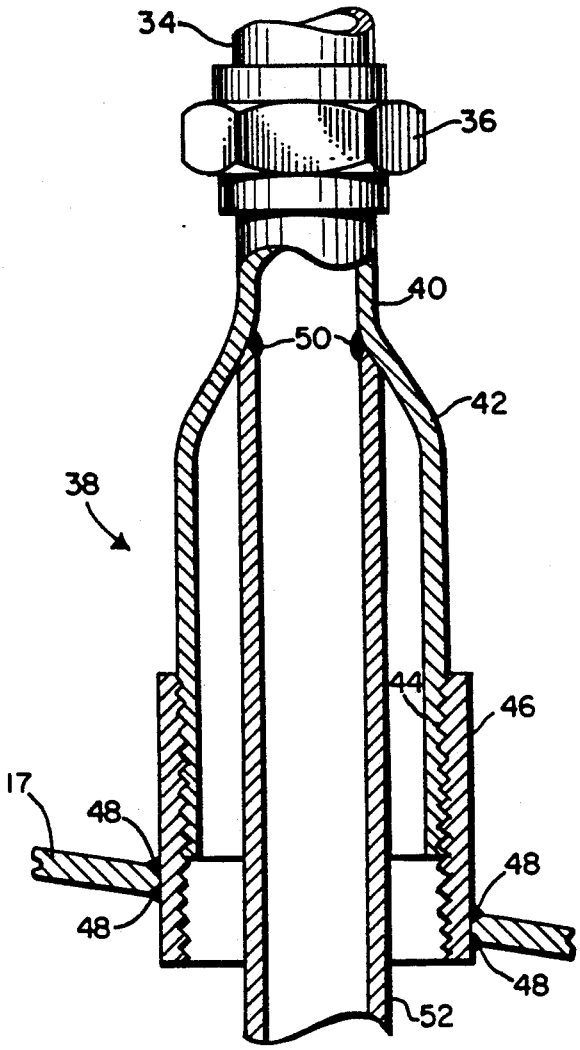
FIG. 6 is an enlarged, cross-sectional view of the top portion of the power jet assembly of the invention.

As shown in FIGS. 1 and 6, pipe 34 is connected by coupling 36 to power jet hanger assembly generally indicated by the numeral 38. Power jet hanger assembly 38 includes a hanger pipe 40 having an enlarged bottom 42. Enlarged bottom 42 has external threads 44 on the outside of the bottom end thereof which are received in top pipe 46 having internal threads 48 therein. Top pipe 46 is connected to top 17 by a weld 48 or by any other suitable method. Coupling 36 is a conventional coupling known to those skilled in art for connecting two pipes such as pipes 34 and 40 together. If desired, top pipe 56 could extend through the side 12 of tank 10, and appropriate elbows added to maintain the lower part of the invention in the position shown in FIG. 1; however, the embodiment shown in FIG. 1 is greatly preferred.

Connected to the inside of hanger pipe 40 by weld 50 is upper support pipe 52. Upper support pipe 52 is connected to sleeve 54. Lower support pipe 56 is connected to the lower end of sleeve 54. Sleeve 54 is a conventional sleeve known to those skilled in art for connecting two pipes such as pipes 52 and 56 together.

Figure 7:
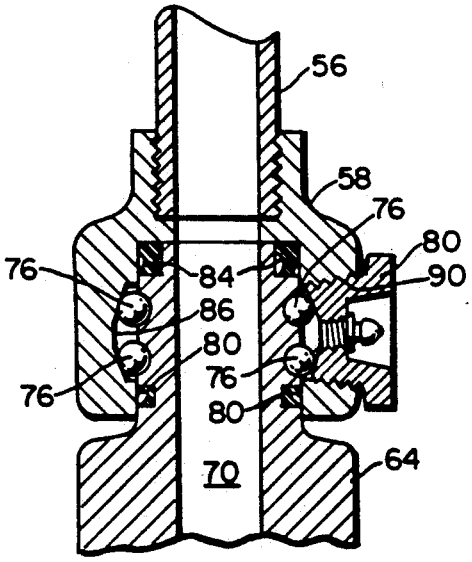
FIG. 7 is an enlarged, cross-sectional view of the union of the rotating jet assembly.

Connected to the lower end of lower support pipe 56 is union 58 which is shown in FIG. 1 and in greater detail in FIG. 7. Rotatably connected to union 58 is the rotating jet assembly generally indicated by the numeral 60 in FIGS. 1–4.

As can be seen in the drawings, rotating jet assembly 60 has two identical power jet assemblies generally indicated by the numeral 62. Power jet assemblies 62—62 are connected to central manifold 64 by two identical hollow arms or pipes 66 having channels 68 therein for conveying liquids from manifold 64 to power jet assemblies 62—62.

Figure 3:
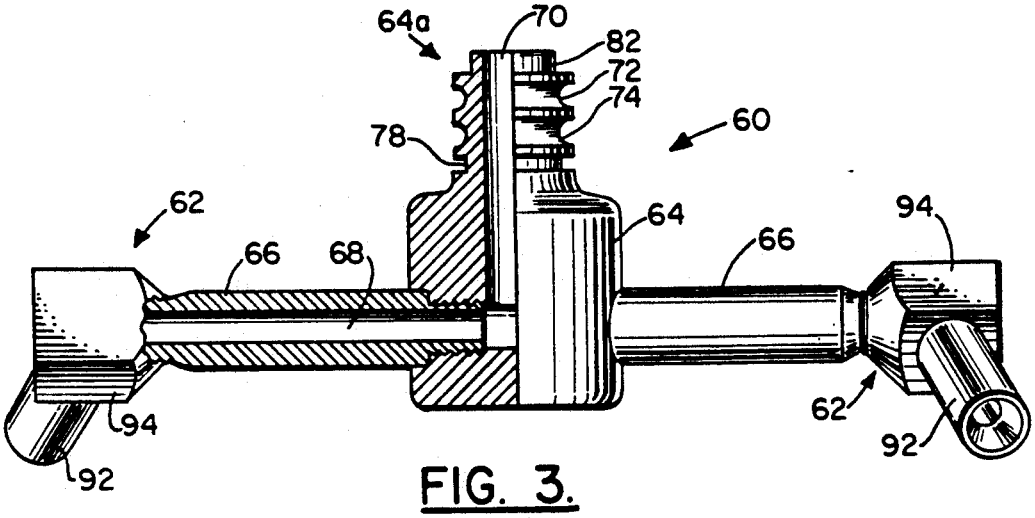
FIG. 3 is a side elevational view, partly cut-away, of the rotating jet assembly.
Figure 4:
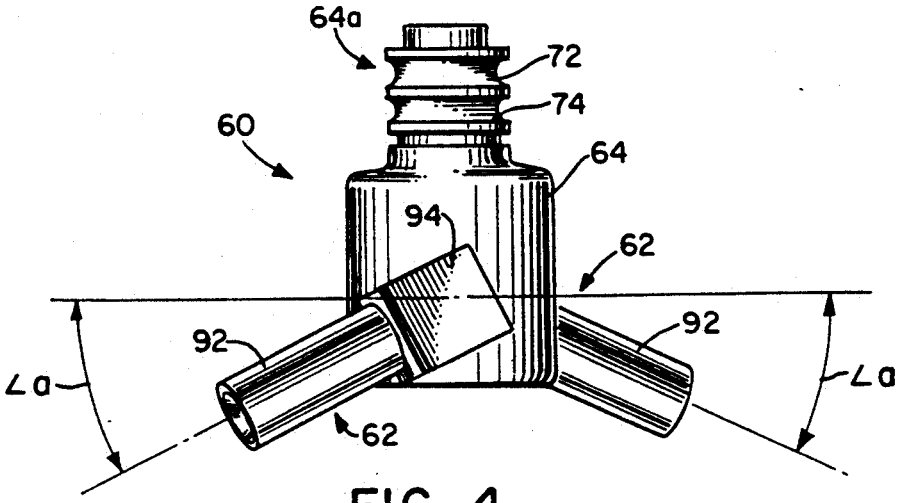
FIG. 4 is an end elevational view of the rotating jet assembly rotated 90 degrees from the position shown in FIG. 3.

As can be seen in FIG. 3, central manifold 64 has a hollow vertical channel 70 therein for receiving liquids under pressure from support pipe 56. In communication with vertical channel 70 are channels 68.

On the upper portion 64*a* at the top of central manifold 64 are two races 72 and 74 in which are received a plurality of ball bearings 76—76 as shown in FIG. 7. A lower slot 78 shown in FIG. 3, 4, and 7 receives packing or washer 80 as shown in FIG. 7. An upper slot 82 shown in FIGS. 3, 4, and 7 receives packing or washer 84 as shown in FIG. 7.

A race 86 is provided inside union 58 for receipt of ball bearings 76—76. A grease fitting 88 is received in threaded access port 90 in central manifold 58.

To assemble central manifold 64 to union 58, the races 72 and 74 on the upper portion 64*a* of manifold 64 are inserted into union 58 as shown in FIG. 7. Next all of the ball bearings 76—76 are inserted through port 90 in union 58. Finally, grease fitting 80 is threaded into port 90.

Figure 5:
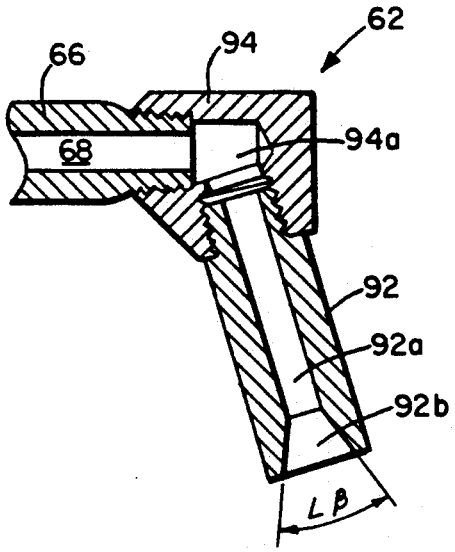
FIG. 5 is an enlarged, cross-sectional view of a power jet.

One power jet assembly 62 is shown in FIG. 5. Power jet assembly 62 includes a jet pipe 92 connected to arm 66 by elbow member 94. Jet pipe 92 has a channel 92*a* therein and nozzle 92*b* through which liquids flow, and elbow member 94 has a channel 94*a* through which liquids flow. Angle alpha is preferably about 25 degrees, and angle beta is preferably about 40 degrees. The power jet assembly 60 is positioned above the floor a distance sufficient to enable liquids sprayed from power jet assembly 60 to strike or flow against the bottom 14 of tank 10. Preferably the power jet assembly is positioned about three or four inches above the bottom 14 of tank 10, distance between jets 92—92 is about ten to about twelve inches.

To remove deposits in the tank 10, heated liquid under pressure such as heated crude oil from a heater-treater heated to a temperature of from about 110° F. to about 220° F. is supplied to pipe 24 flowing in the direction indicated by the arrow adjacent to pipe 24 in FIG. 1. The liquid is heated to a temperature above the melting point of any solids that may be contained in tank 10 to dissolve or emulsify the solid deposits. The heated liquid flows through elbow 26, pipe 28, valve 30, pipe 34, coupling 36, hanger pipe 40, upper support pipe 52, sleeve 54, lower support pipe 56, union 58, central manifold 64, arms 66, elbow 62, and outward through jet 92. Oil leaving jet 92 is indicated by the numeral 96 in FIG. 1.

As oil 96 leaves jet 92, the power jet assembly 60 rotates in the direction indicated by the two arrows adjacent thereto in FIG. 1. Turbulence will be created in the bottom of tank 10 and prevent heavy deposits from forming in the bottom of tank 10. Furthermore, if heavy deposits of solids have formed in the bottom or sides of the tank 10 when power jet assembly 60 was not in operation, operation of the power jet assembly 60 will reduce and convert such solid deposit to the liquid state so that all of the contents of the tank 10 can be pumped from the tank 10 thus removing solids in the tank 10. Therefore, solid residue in the bottom of tanks can be converted to liquids and pumped from the tank utilizing the present invention.

The invention may be operated periodically to prevent solids from forming in the bottom of tank 10. Liquids under pressure from a heater-treater drive jet assembly 62—62 and cause the assembly 62—62 to rotate. The length of the period of time between operation of the invention will depend upon the liquid being stored therein and the rate at which solids form therein. Furthermore, the invention may be operated when the tank is partially filled with liquids or when all liquids have been removed from the tank.

Although the preferred embodiments of the invention have been described in detail above, it should be understood that the invention is in no sense limited thereby, and its scope is to be determined by that of the following claims:

What is claimed is:

1. An apparatus for preventing formation of crude oil solids in a crude oil storage tank and for removing and recovering crude oil solids contained in said crude oil storage tank by dissolving said crude oil solids with heated crude oil, said crude oil tank having a bottom from which cylindrical sidewalls extend vertically upward, said crude oil storage tank being generally cylindrical in shape, the longitudinal axis of said cylindrical crude oil storage tank being generally perpendicular to the bottom of said tank, said crude oil storage tank having a top connected to said cylindrical sidewalls for covering the interior of said tank, said apparatus comprising:

a. pipe means rigidly connected to said top of said crude oil storage tank for conveying crude oil heated above the melting point of any crude oil solids contained in said crude oil storage tank from the exterior of said crude oil storage tank to the interior of said crude oil storage tank, said crude oil being under pressure, and b. rotatable jet means rotatably connected to said pipe means for receiving said heated crude oil from said pipe means and for spraying said heated crude oil toward said bottom of said tank, said rotatable jet means being supported by said pipe means inside said crude oil storage tank in a fixed position above said bottom of said crude oil storage tank, said rotatable jet means having a manifold means rotatably connected to said pipe means for conveying crude oil, said manifold means having a plurality of jets connected thereto pointed toward the bottom of said crude oil storage tank, said rotatable jet means being positioned above said bottom of said crude oil storage tank a distance above said bottom sufficient to enable heated crude oil spraying from said plurality of jets to strike said bottom of said crude oil storage tank to dissolve any solids collected on said bottom from said bottom.

2. The apparatus of claim 1 wherein said jets form an angle with the horizontal of about 25 degrees.

3. The apparatus of claim 2 wherein each of said jets have a nozzle therein.

4. The apparatus of claim 3 wherein said nozzle is cone-shaped.

5. The apparatus of claim 4 wherein the walls of said cone-shaped nozzle have an angle of about forty degrees.

6. The apparatus of claim 1 wherein said rotatable jet means is supported about three to four inches above said bottom of said crude oil storage tank.

* * * * *